United States Patent [19]

Norris et al.

[11] Patent Number: 4,803,494

[45] Date of Patent: Feb. 7, 1989

[54] WIDE BAND ANTENNA

[75] Inventors: Andrew P. Norris, Great Dunmow; Martin S. Smith, Chelsmford, both of Great Britain

[73] Assignee: STC PLC, London, England

[21] Appl. No.: 145,930

[22] Filed: Jan. 20, 1988

[30] Foreign Application Priority Data

Mar. 14, 1987 [GB] United Kingdom ..... 8706114

[51] Int. Cl.[4] ..... H01Q 13/10

[52] U.S. Cl. ..... 343/770; 343/746

[58] Field of Search ..... 343/770, 746

[56] References Cited

U.S. PATENT DOCUMENTS

| | | | |
|---|---|---|---|
| 2,557,951 | 6/1951 | DeRosa | 343/770 |
| 2,832,955 | 4/1958 | Jasik | 343/770 |
| 3,009,153 | 11/1961 | Masters et al. | 343/770 |
| 3,031,665 | 4/1962 | Marié | 343/770 |
| 4,242,685 | 12/1980 | Sanford | 343/770 |

FOREIGN PATENT DOCUMENTS

| | | | |
|---|---|---|---|
| 128903 | 6/1980 | Japan | 343/770 |
| 653018 | 5/1951 | United Kingdom | 343/770 |

*Primary Examiner*—William L. Sikes
*Assistant Examiner*—Robert E. Wise
*Attorney, Agent, or Firm*—Lee & Smith

[57] ABSTRACT

A cavity backed crossed slot antenna wherein the cavity depth d is less than one eighth of the operating wavelength λ at the lowest frequency of operation, the major dimension a of the cavity in the plane of the slots is less than one half of the wavelength λ at the lowest operating frequency, and the slots are excited by four symmetrically located capacitive coupled feed probes.

3 Claims, 1 Drawing Sheet

WIDE BAND ANTENNA

FIELD OF THE INVENTION

This invention relates to a wide band circularly polarised antenna with hemispherical coverage.

DESCRIPTION OF RELATED ART

There are many applications, particularly for aircraft, where compact low profile antennas are required. In many cases there is a requirement for a circularly polarised antenna. One structure which meets this requirement is a cavity backed crossed slot antenna, which can provide circular polarisation with hemispherical coverage (ideally 5dBic normal to the plane of the slots, reducing to −1dBic in the plane of the slots). The two orthogonal slots are fed in phase quadrature. In one approach the slots are fed with 0° and 90° phase, with symmetrical amplitude excitation. In another approach four feeds are used, spaced 90° apart in angle and fed with 0°, 90°, 180° and 270° of phase respectively. Such an arrangement, using hybrids to provide the feeds, is disclosed by King H. E. et al, "A shallow ridged cavity crossed slot antenna for the 240 to 400 MHz frequency range", IEEE Transactions, AP-23, pp 687–689, September 1975.

It is an object of the present invention to provide a compact, low profile circularly polarised antenna having a good input match over a 50% bandwidth (transmission loss between 0 and 1.5 dB) with fundamental mode slot excitations at all frequencies in the band.

SUMMARY OF THE INVENTION

According to the invention there is provided a cavity backed crossed slot antenna wherein the cavity depth d is less than one eighth of the operating wavelength * at the lowest frequency of operation, the major dimension a of the cavity in the plane of the slots is less than one half of the wavelength at the lowest operating frequency, and the slots are excited by four symmetrically located capacitive coupled feed probes.

BRIEF DESCRIPTION OF THE DRAWINGS

Embodiments of the invention will now be described with reference to the accompanying drawings, in which.

DESCRIPTION OF THE PREFERRED EMBODIMENTS

Figure 1:
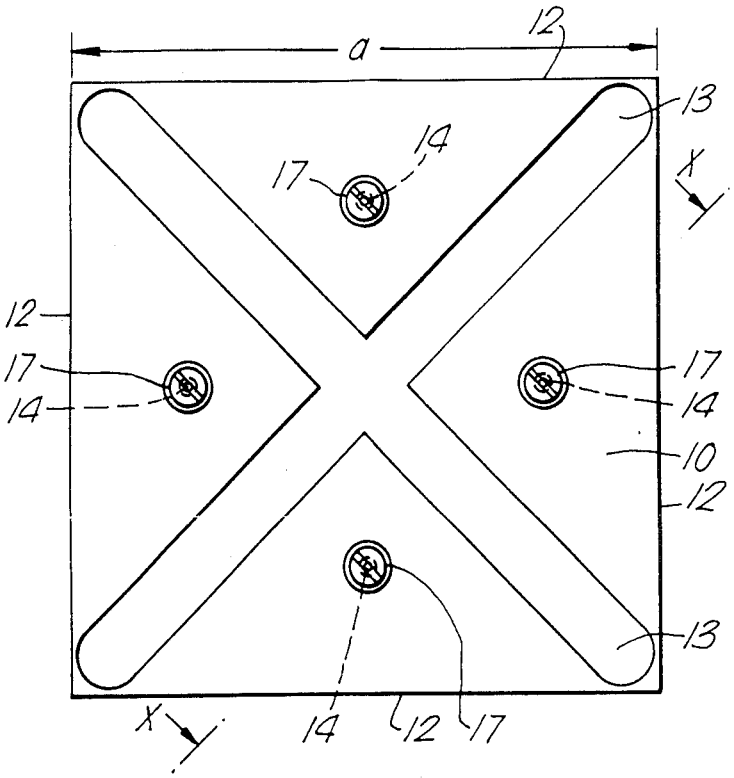
FIG. 1 is a plan view illustration of a shallow cavity backed crossed slot antenna.
Figure 2:
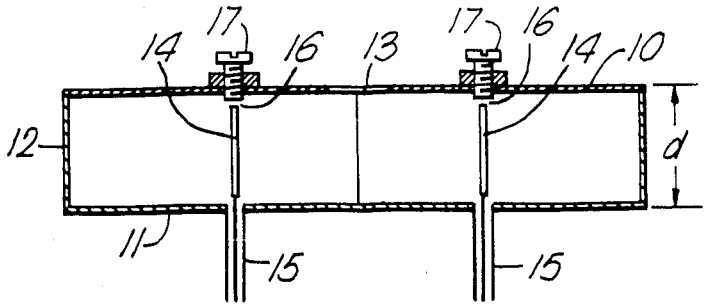
FIG. 2 is a sectional illustration taken on the line x—x of FIG. 1.

The antenna illustrated comprises a rectangular metal, e.g. copper, box having a top wall 10, a bottom wall 11 and four side walls 12. The top wall has crossed slots 13 formed diagonally. The bottom wall carries four feed probes 14 positioned symmetrically with respect to the crossed slots. The probes are connected via insulated lead-throughs 15 in the bottom wall. The probes extend into the interior of the box towards the top wall and are separated therefrom by gaps 16. In a preferred embodiment the top wall 10 is provided with metal tuning screws 17 whereby the capacitive coupling between the probes and the triangular sections of the top wall can be adjusted. The box may be filled with a solid dielectric material or be air-filled. To excite the antenna the four probes are fed with r.f. signals having successively 0°, 90°, 180° and 270° of phase.

The dimensions of the antenna are governed by the range of operating frequencies. In particular the depth d of the box is less than one eighth of the wavelength of the lowest frequency of operation, i.e. $d<\lambda/8$ where $\lambda$ is the longest wavelength. Similarly the major dimension a of the box is less than one half of the longest wavelength, i.e. $a<\lambda/2$. Typically an antenna with an air filled cavity designed to operate from 1400 MHz up has dimensions d=20 mm and a=100 mm, with the slot width being 10 mm. The feed probes are located 30 mm from the centre of the crossed slots.

The four triangular sections of FIG. 1 can be considered as being equivalent to four patch antennas. The four feeds are then equivalent to the probes normally used to excite patch antennas. The series capacitance provided by the gap in each probe provides a broadband match. Alternatively the matching can be provided by external matching networks. However, as constructed the antenna illustrated also provides the equivalent of so-called "shorted patches" by virtue of the side walls which electrically connect the triangular patches of the top to the effective ground plane of the bottom. An important feature of the antenna is that the slot excitation should remain in the fundamental mode across the band of frequencies. This can be demonstrated to be true for the antenna illustrated over a bandwidth of 50% (defined as $\Delta f/fo$ ($\times 100\%$) where the frequency band is $fo-\Delta f/2 \leqq f \leqq fo+\Delta f/2$). Our radiation pattern measurements show that the hemispherical coverage pattern is maintained over the band, implying fundamental mode operation only. The 50% bandwidth for a good input match (less than 1.5 dB transmission loss) is greater than anticipated for a single patch.

I claim:

1. A cavity backed crossed slot antenna wherein the cavity depth is less than one eighth of the operating wavelength at the lowest frequency of operation, the major dimension of the cavity in the plane of the slots is less than one half of the wavelength at the lowest operating frequency, and the slots are excited by four capacitive coupled feed probes extending through the bottom wall of the cavity, the probes being located symmetrically with respect to the crossed slots and the ends of the probes being separated from the top wall by gaps to provide the capacitive coupling.

2. An antenna according to claim 1 wherein the top wall is provided with metal tuning screws each arranged to adjust the gaps between the top wall and the end of an associated feed probe.

3. An antenna according to claim 1 wherein the cavity contains solid dielectric material.

* * * * *